US005328235A

United States Patent [19]

Saul et al.

[11] Patent Number: 5,328,235

[45] Date of Patent: Jul. 12, 1994

[54] PAWL AND RATCHET ASSEMBLY

[75] Inventors: Jonathan R. Saul, LaSalle; Karl J. Komorowski, Petersburg; Larry P. LaPointe, Temperance; Edwin J. Shoemaker, Monroe, all of Mich.

[73] Assignee: La-Z-Boy Chair Company, Monroe, Mich.

[21] Appl. No.: 826,691

[22] Filed: Jan. 31, 1992

[51] Int. Cl.[5] ..... A47C 3/02

[52] U.S. Cl. ..... 297/270

[58] Field of Search ..... 297/270, 259, 269

[56] References Cited

U.S. PATENT DOCUMENTS 3,096,121 7/1963 Knabusch et al. .

4,179,157 12/1979 Shoemaker et al. .

*Primary Examiner*—James R. Brittain

*Attorney, Agent, or Firm*—Harness, Dickey & Pierce

[57] ABSTRACT

An improved latching mechanism for a rocking chair having an extensible leg rest assembly is disclosed. The latching mechanism is operable to releasably lock the chair frame in a rearwardly tilted position upon extension of the leg rest assembly while permitting unrestricted rocking action when the leg rest assembly is protracted. The improved latching mechanism is a pawl and ratchet latching mechanism having a spring-biased pawl member operable to lockingly engage a toothed ratchet sector for retaining the chair frame in its rearwardly tilted position. A unique actuation arrangement is disclosed having a release member that functions to pull the spring-biased pawl member to a released position. The actuation arrangement is also operable to prevent the release member from exerting any compressive biasing loading on the pawl member when the pawl member is in locked engagement with the ratchet teeth.

36 Claims, 5 Drawing Sheets

FIG 7
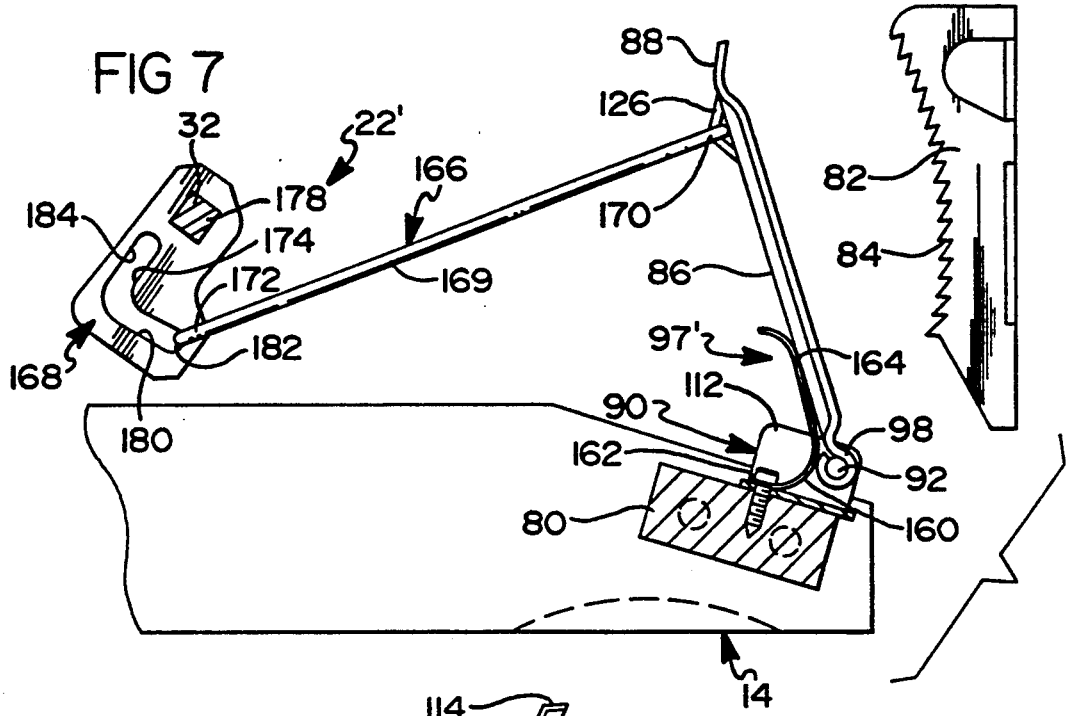
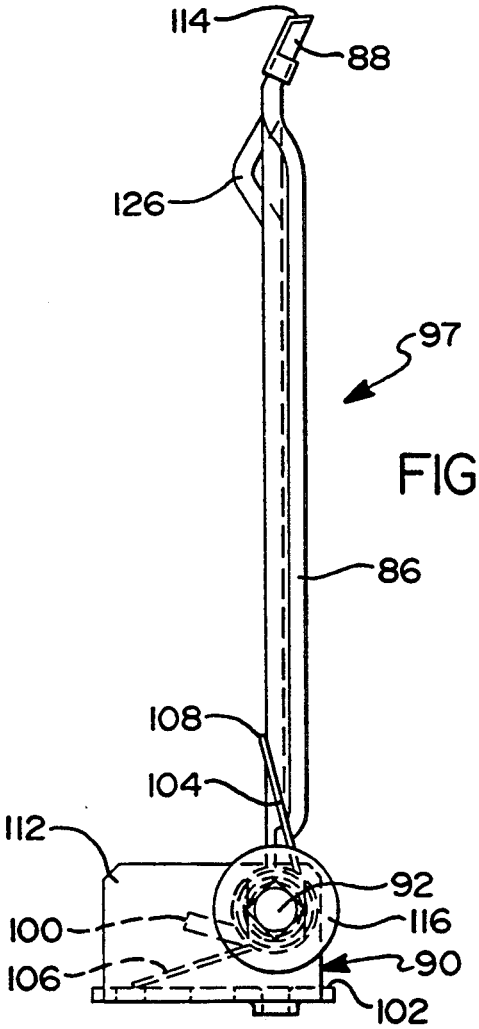
FIG 6

PAWL AND RATCHET ASSEMBLY

BACKGROUND OF THE INVENTION

The present invention relates generally to rocking chairs and, more particularly, to a rocking chair having an extensible leg rest assembly and an improved latching mechanism operable for releasably retaining the chair on a rearwardly "tilted" position following extension of the leg rest assembly.

Most rocking chairs typically include an upholstered chair frame supported from a stationary base assembly in a manner permitting the chair frame to "rock" freely in forward and rearward movements with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism for permitting the seat occupant to selectively move the leg rest assembly between its normally retracted (i.e., "stowed") and elevated (i.e., "extended") positions. The drive mechanism is manually-operated and includes a handle which when rotated by the seat occupant, causes concurrent rotation of a drive rod for extending or retracting the leg rest assembly.

As an additional comfort feature, a latching mechanism may also be provided for releasably retaining the chair frame in a rearwardly rocked or "tilted" position on the base assembly following extension of the leg rest assembly to its extended position. In this manner, normal "rocking" action of the rocking chair is inhibited until the leg rest assembly is returned to its normally "stowed" position. Applicant's above-mentioned U.S. Patents each disclose the use of a "one-way" pawl and ratchet type latching mechanism having a pawl member supported for pivotable movement from the base assembly and a toothed ratchet sector fixed to the chair frame. An elongated U-shaped spring link is used to couple the pawl member to a drive link fixed to the drive rod. Movement of the pawl member between positions of engagement and disengagement with the toothed sector is caused in response to movement of the leg rest assembly between its extended and retracted position respectively. More particularly, when the handle is slightly rotated for partially extending the leg rest assembly, concurrent rotation of the drive rod and the drive link causes the spring link to forcibly pivot the pawl member toward the ratchet sector until its locking tip is positioned in locked engagement with the teeth of the ratchet sector. Thereafter, continued rotation of the drive rod and drive link for completely extending the leg rest assembly causes "elastic" flexure of the elongated spring link for applying a compressive force on the pawl member. However, the magnitude of the compressive force exerted by flexure of the spring link can vary since the displacement between the drive rod and sequential ratchet points on the ratchet sector vary in response to rearward tilting movement of the chair frame. Therefore, the flexure of the elongated spring link must be sufficient to ensure that the compressive force exerted on the pawl member is sufficient to maintain locked engagement between the pawl member and the teeth of the ratchet sector throughout the entire range of rearward "tilting" movement of the chair frame.

While such conventional latching mechanisms have generally performed satisfactorily, they are inherently noisy due to the spring link exerting a large compressive force on the locking tip of the pawl member at it "ratchets" over the the ratchet sector upon rearward tilting movement of the chair frame. In addition, the cyclical flexural requirements of the spring link may lead to premature fatigue fallure which could possibly cause unintentional release of the chair frame from its rearwardly tilted position.

SUMMARY OF THE INVENTION

In accordance with the principle of the present invention, an improved latching mechanism is disclosed which is designed to overcome the disadvantages associated with conventional latching mechanisms used in rocking chairs of the type having extensible leg rest assembles. Therefore, a primary object of the present invention is to provide an improved pawl and ratchet latching mechanism which is designed to substantially minimize the "ratcheting" noise commonly associated with its operation.

It is an additional object of the present invention to provide an improved pawl and ratchet latching mechanism having a spring-biased pawl assembly which is designed to exert a controlled biasing force on the pawl member. In accordance with a first embodiment, the spring-biased pawl assembly includes a torsion spring that is arranged to normally bias the pawl member toward a position of engagement with the ratchet sector. The torsion spring effectively relocates and reduces the engagement force between the pawl member and the ratchet sector in a manner facilitating a significant noise reduction.

Yet another object of the present invention is to provide an improved pawl and ratchet latching mechanism having a unique actuation arrangement operable for transforming rotation of the drive rod into pivotable movement of the pawl member. The unique actuation arrangement includes a "non-loaded" release link that is used solely for "pulling" the locking tip of the pawl member out of engagement with the teeth of the ratchet sector. In this manner, the release link is not required to exert cyclical compressive loading on the pawl member which significantly improves the overall service life of the improved latching mechanism.

As a related object, the unique actuation arrangement is used in conjunction with the drive mechanism for facilitating universal application of the improved latching mechanism into various different rocking chair and base assembly combinations.

It is still another object of the present invention to provide an improved pawl and ratchet latching mechanism in wherein the "non-loaded" release link can be easily assembled and/or replaced in the field without the necessity of tools.

In accordance with one embodiment of the present invention, an exemplary rocking chair is disclosed having an extensible leg rest assembly. The leg rest assembly may be operated by the seat occupant rotating an actuator handle through a limited angle which, in turn, rotates the drive rod for selectively extending or retracting a pair of leg rest linkages. The improved pawl and ratchet latching mechanism includes a spring-biased pawl assembly supported for pivotable movement from the stationary base assembly and a toothed ratchet sector fixed to a portion of the rockable chair frame. The spring-biased pawl assembly includes a pawl member and spring means for normally biasing the pawl member toward the ratchet sector for continuously exerting a controlled engagement force on the pawl member. A first end of the non-loaded release link is secured to the pawl member and a second end of the non-loaded release link is retained within an elongated lost-motion guide slot formed in a swivel lever which is journally supported on the drive rod. A trip link is fixed for rotation on the drive rod and is adapted to act on the swivel lever for controlling rotation of the swivel lever upon rotation of the drive rod. With the leg rest retracted, the trip link acts on the swivel lever such that the release link "pulls" on the pawl member in opposition to the biasing of the spring means for retaining the pawl member in a position disengaged from the teeth of the ratchet sector. With the leg rest extended, the trip link is released from the swivel lever such that the biasing force of the spring means pulls the release link until the pawl member engages the teeth of the ratchet sector. Thereafter, the spring means exerts a controlled biasing force on the pawl member for maintaining locked engagement with the ratchet sector. The lost-motion guide slot are designed to inhibit exertion of compressive loading on the release link following locked engagement of the pawl member with the ratchet teeth.

Additional objects, advantages and features of the present invention will become apparent to one skilled in the art from the following description and appended claims, taken in conjunction with the accompanying drawings.

DESCRIPTION OF THE DRAWINGS

FIG. 6 is a side view of the spring-biased pawl assembly shown in FIG. 5; and FIG. 7 illustrates an alternative embodiment of an improved pawl and ratchet latching mechanism.

DETAILED DESCRIPTION OF THE PREFERRED EMBODIMENTS

Figure 1:
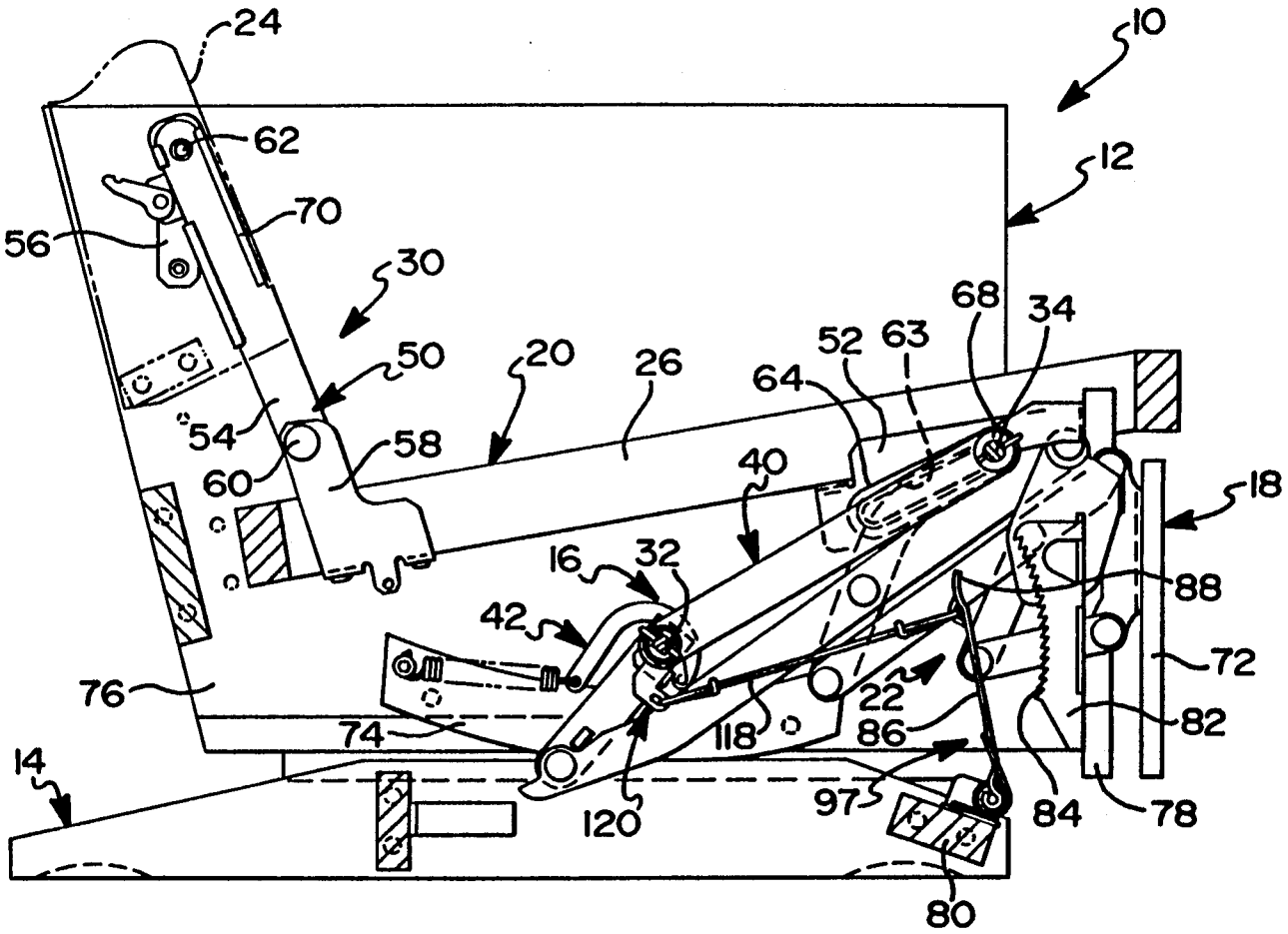
FIG. 1 is a side elevational view of an exemplary rocking chair having an extensible leg rest assembly and an improved pawl and ratchet latching mechanism constructed in accordance with a preferred embodiment of the present invention.

With particular reference to FIG. 1 of the drawings, an exemplary rocking chair is shown. More particularly, the exemplary rocking chair is a combination recliner and platform rocker, hereinafter referred to reclining/rocking chair 10. In general, reclining/rocking chair 10 includes a rigid chair frame 12, a base assembly 14, a manually-operated drive mechanism 16, an extensible leg rest assembly 18 and a "reclinable" seat assembly 20. In addition, an improved pawl and ratchet latching mechanism 22 is shown which is constructed in accordance with a first preferred embodiment of the present invention. However, it is to be understood that reclining/rocking chair 10 is exemplary in nature and is merely intended to illustrate the type of rocking chair to which improved pawl and ratchet latching mechanism 22 can be operably associated. For purposes of clarity, reclining/rocking chair 10 is shown with its upholstery, padding, springs, etc. removed to better illustrate the interdependency of the various components and mechanical linkages.

Figure 3:
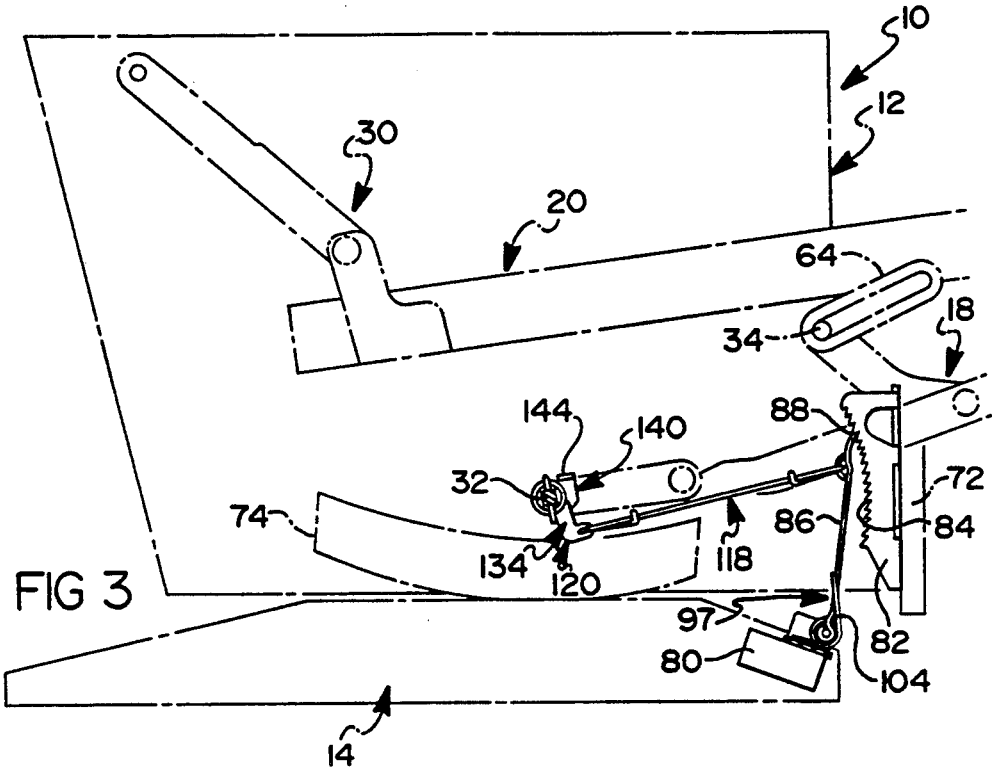
FIG. 3 shows the rocking chair of FIG. 1 with the leg rest assembly in an "extended" position for illustrating movement of the pawl and ratchet latching mechanism to a "locked" position.
Figure 4:
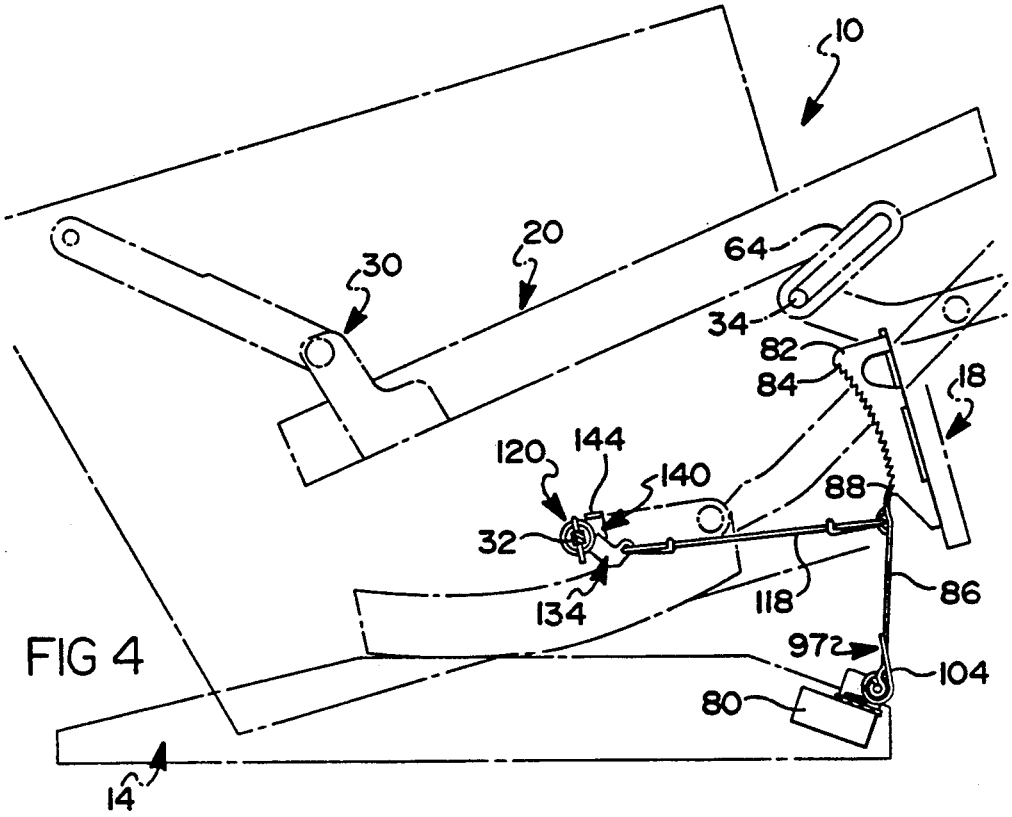
FIG. 4 is a view, similar to FIG. 3, showing the rocking chair locked in a rearwardly "tilted" position with the pawl and ratchet latching mechanism in another "locked" position.

Combination reclining/rocking chair 10 is shown in FIG. 1 as having seat assembly 20 in a fully "upright" position and leg rest assembly 18 in its normally retracted or "stowed" position for permitting the seat occupant to enjoy conventional seating. Seat assembly 20 includes a seat back 24 which can be "reclined" relative to a seat member 26 independent of whether leg rest assembly 18 is positioned in the "stowed" position or the "extended" position. Such "reclining" movement of seat assembly 20 and protraction of leg rest assembly 18 to the "extended" position are shown in FIGS. 3 and 4. Reclining movement of seat assembly 20 is accomplished upon the seat occupant deliberately applying pressure to seat back 24 such that a seat swing linkage 30 causes seat member 26 to move forwardly and upwardly for maintaining seating comfort while the included angle increases therebetween. Reclining/rocking chair 10 may be easily returned to its "upright" position upon deliberate application of rearward pressure to seat assembly 20 or, more simply, if the seat occupant leans forward to remove pressure from seat back.

Figure 2:
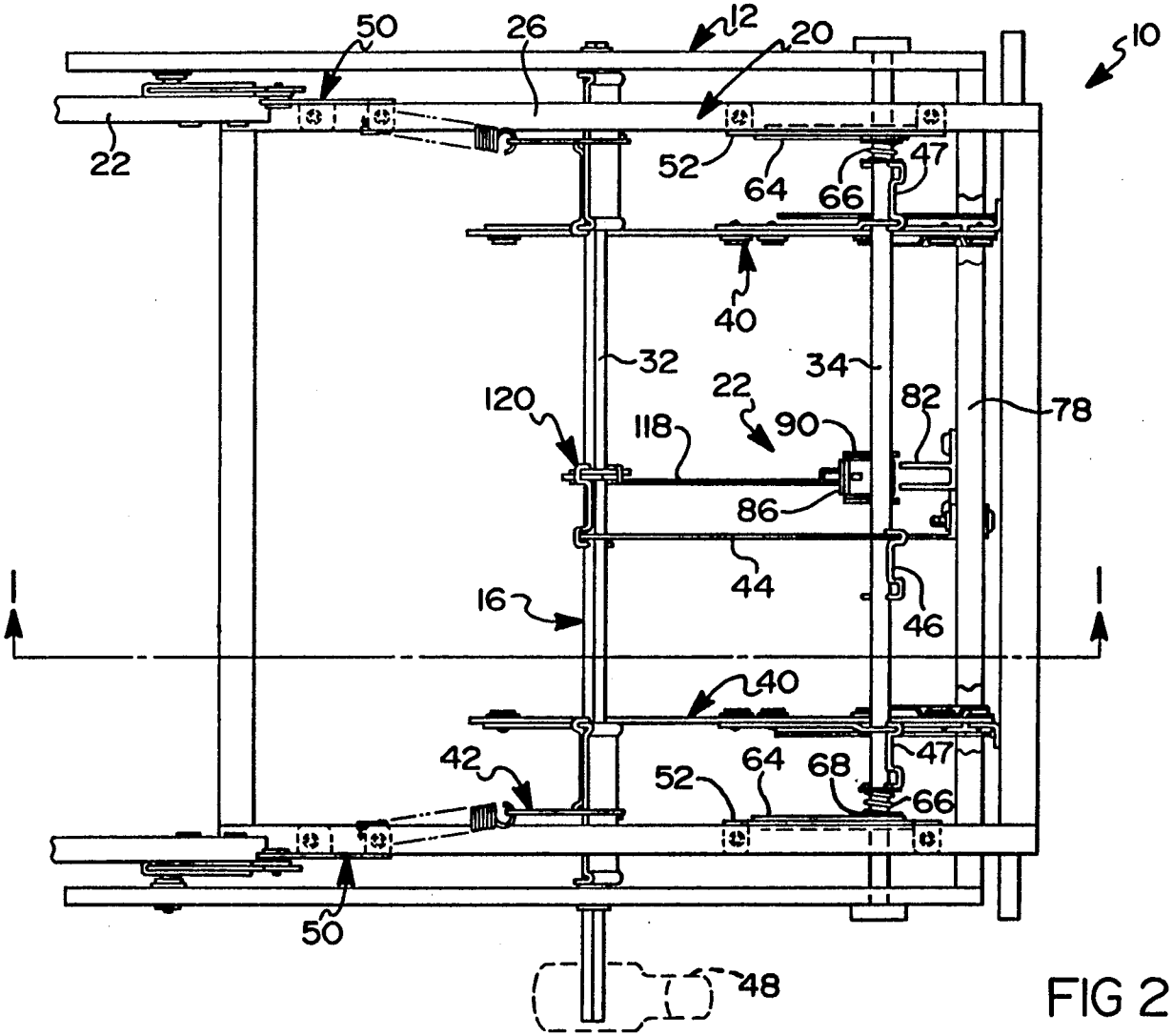
FIG. 2 is a partial plan view of FIG. 1.

As best seen from FIGS. 1 and 2, manually-operated drive mechanism 16 of reclining/rocking chair 10 is integrated into and operably suspended from chair frame 12. As will be described in greater detail hereinafter, drive mechanism 16 includes a drive rod 32 and a front support shaft 34, both of which are spatially oriented to be precisely located and "suspended" from chair frame 12. A preferred method of assembling reclining/rocking chair 10 using preassembled modular frame components is thoroughly disclosed in Applicant's U.S. application Ser. No. 07/772,231, filed Oct. 11, 1991, the disclosure of which is expressly incorporated by reference herein.

With continued reference to FIGS. 1 and 2, drive mechanism 16 is shown to operably support leg rest assembly 18 thereon. More specifically, leg rest assembly 18 includes left and right pantograph linkages 40 and at least one spring-assisted over-center toggle linkage 42 which are operably associated with drive rod 32 and front support shaft 34 for permitting the seat occupant to selectively actuate leg rest assembly 18. A rigid cross-brace 44 is secured between drive rod 32 and support shaft 34 for providing structural rigidity within drive mechanism 16. Furthermore, support shaft 34 is fixed to cross-brace 44 via a spacer clip 46 to inhibit rotation of support shaft 34 upon rotation of drive rod 32. In the construction shown, drive rod 32 is an elongated square shaft having an actuation lever or handle 48 which is typically provided adjacent an upholstered exterior portion of chair frame 12 and that can be easily reached by a person seated in chair 10 for convenient actuation thereof.

As noted, seat member 26 is supported for movement relative to chair frame 12 by means of seat swing linkage 30 for causing seat member 26 to move substantially horizontally and slightly up or down, depending on whether seat member 26 moves forwardly (i.e., during "reclining" movement) or rearwardly (i.e., on return to the "upright" position). Seat swing linkages 30 are shown as left and right hand rear swing linkages 50 and left and right hand front slide brackets 52. Each rear swing linkage 50 includes an elongated swing link 54, a support bracket 56 and a seat bracket 58. The lower end of each rear swing link 54 is pivoted about a pivot point 60 to an upstanding post section of seat bracket 58. Seat bracket 58 has a horizontal flange portion that is securely fixed (such as by wood screws) to an underside surface of a seat member 26. As such, loading on the rear of seat member 26 passes from seat brackets 58 into rear swing links 54 as tension loading which is transferred by way of upper pivots 62 through support brackets 56 and into chair frame 12. Rear swing links 54 are elongated to provide increased leverage for balanced reclining action. Thus, the rear of seat member 26 moves much like a controlled pendulum on and below upper pivots 62.

Seat swing mechanism 30 also includes a pair of (i.e., left and right) front slide brackets 52 which are operable to guide and limit fore and aft movement of seat member 26. More particularly, front support shaft 34 extends through elongated guide slots 63 formed in left and right slide brackets 52 which have horizontal flanges securely fixed (such as by wood screws) to an underside surface of the front end of seat member 26. As will be appreciated, the angularity and length of guide slots 63 defines the range of fore and aft movement of seat member 26 relative to chair frame 12 upon the seat occupant applying a force to move seat assembly 20 between the "upright" and "reclined" positions. In addition, means are also provided for generating a predetermined amount of frictional drag upon movement of seat member 26 with respect to support shaft 34. In the particular embodiment shown, a nylon insert 64 is fixedly retained within guide slots 63. In addition, compression springs 66 are provided which concentrically surround opposite ends of support shaft 34 for biasing a disk-like washers 68 into frictional engagement with nylon inserts 64. Nylon insert 64 works in conjunction with compression springs 66 for controlling the friction resistance to movement of the front end of seat assembly 20 with respect to support shaft 34 while concomitantly acting to effectively dampen noise. Left and right spacer clips 47 are provided for preloading compression springs 66 and for positively locating and retaining pantographic leg rest linkages 40 on support shaft 34.

Seat back 24 is removably mounted on an upper portion of rear swing links 54 by means of slide brackets 70 secured at suitable locations on seat back 24. A preferred construction of slide brackets 70 for this type of mounting is shown and described in U.S. patent application Ser. No. 07/621,239 filed Nov. 30, 1990, assigned to the common assignee of the present invention, the disclosure of which is expressly incorporated by reference herein. In general, slide brackets 70 are channel-shaped to provide an interior track that slidably receives rear swing links 54 therein. When slide brackets 70 are mounted on rear swing links 54, seat back 24 is, in effect, an extension of rear swing links 54 above pivot points 62. As such, seat back 24 can be pivoted about pivots 62 for acting as a lever arm for causing relatively easy angularly movement of rear swing links 54 and fore and aft movement of seat member 26.

Leg rest assembly 18 is shown to include a frame board 72 supported and moved by identical left and right hand pantograph linkages 40. Pantograph linkages 40 are substantially identical in function and structure to that shown in FIG. 3 of U.S. Pat. No. 3,096,121, assigned to the common assignee of the present invention, with the exception that pantograph linkages 40 are operably suspended from support shaft 34. The "extensible" action takes place simultaneously with both the left hand and right hand pantograph linkages 40 when there is sufficient angular rotation of drive rod 32 via rotation of actuation handle 48. In this manner, frame board 72 is movable between a normally "stowed" position when pantograph linkages 40 are retracted and its "extended" position when pantograph linkages 40 are protected. As is known, leg rest assembly 18 may be returned to its "stowed" position upon the seat occupant applying a rearwardly directed force on frame board 72 or upon rotation of actuation handle 48 in the opposite direction.

To provide means for permitting chair frame 12 to rock relative to stationary base assembly 14, contoured rocker blocks 74 are secured to inner surfaces of chair frame side panels 76. Rocker blocks 74 are positioned to engage an upper surface of base assembly 14 in a "rockable" relation therewith. Preferably, rocker block 74 are interconnected to base assembly 14 by a double coil spring "rocker" device (not shown) similar to that disclosed in U.S. Ser. No. 666,348 filed Mar. 8, 1991, commonly owned by the assignee of the present invention, the disclosure of which being expressly incorporated by reference herein. As will be appreciated, the rocker spring device is operable to permit balanced rocking movement of chair frame 12 with respect to fixed base assembly 14 without causing seat assembly 20 to recline inadvertently.

As an additional comfort feature, latching means are provided for releasably retaining chair frame 12 in any one of a plurality of rearwardly "tilted" sequential positions upon leg rest assembly 18 being selectively moved to its fully extended position. As such, the latching means is operable to inhibit forward rocking movement of chair frame 12 following initial rearward movement of chair frame 12 to a desired "tilted" position. The latching means of the present invention is directed to pawl and ratchet latching mechanism 22 which is controllably actuated in response to angular movement of drive rod 32. Pawl and ratchet latching mechanism 22 is an improvement over conventional latching arrangements and is specifically designed to provide increased service life and a reduction in the "ratcheting" noise generated upon actuation.

In general, pawl and ratchet latching mechanism 22 is operably arranged between a front rail member 78 of chair frame 12 and forward cross-rail 80 of base assembly 14 for providing a plurality of sequentially lockable rearwardly "tilted" position. Pawl and ratchet latching mechanism 22 includes an arcuately contoured ratchet sector 82 that is secured to an inner surface of front cross-member 78 and is formed to define a plurality of teeth 84 thereon. A latching bar or pawl member 86 having an upper chisel-shaped locking tip 88 is supported at its lower end for pivotable movement about hinge pin 92 on a pawl bracket 90. Pawl bracket 90 is secured to forward cross-rail 80 of base assembly 14. Pawl member 86 is pivotably movable with respect to sector teeth 84 between a disengaged ("released") position (as shown in FIG. 1) for permitting normal "rocking" action of chair 10, and an engaged ("locked") position (as shown in FIG. 3) for permitting rearward "tilting" of chair frame 12 while inhibiting any subsequent forward "rocking" movement of chair frame 12.

Figure 5:
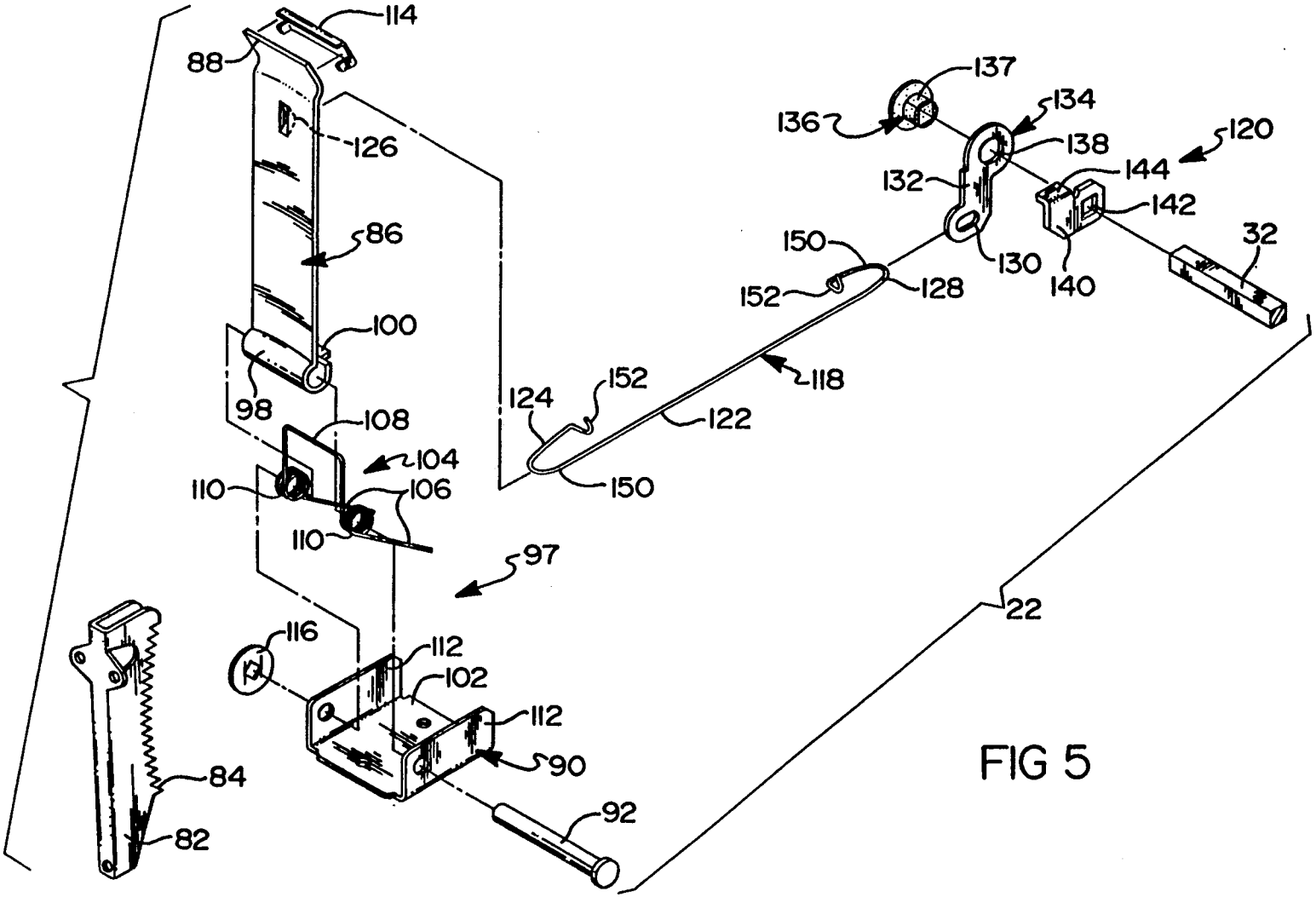
FIG. 5 is an exploded perspective view of the pawl and ratchet latching mechanism shown in FIGS. 1 through 4.

As best seen in FIGS. 5 and 6, a spring-biased pawl assembly 97 includes pawl member 86 having a hinged bottom end constructed from a cylindrical portion 98 and which is secured by hinge pin 92 to pawl bracket 90. A rearwardly extending tang 100 is formed on pawl member 86 which is engagable with base surface 102 of pawl bracket 90 for limiting rearward movement of pawl member 86 toward its "released" position. A spring biasing member is provided for normally biasing pawl member 86 in a direction toward ratchet sector 82 or, more simply, toward the "locked" position. In the first preferred construction, the spring biasing member is a dual torsion spring 104 having a pair of laterally spaced legs 106, the free ends of which are maintained in contact with base surface 102 of pawl bracket 90. A transversely extending arm 108 interconnects laterally spaced legs 106 and is arranged to engage a rear surface of pawl member 86 in relatively close proximity to its pivot axis about hinge pin 92. The proximity of arm 108 to hinge pin 92 is advantageous in that the biasing force of dual torsion spring 104 is applied to pawl member at a point displaced from locking tip 88 for effectively reducing noise generated upon locking tip 88 "ratcheting" over sector teeth 84.

Dual torsion spring 104 also includes aligned sets of loops 110 formed in legs 106 and which are arranged to concentrically surround hinge pin 92 between the outer edge surfaces of pawl cylindrical portion 98 and the inner surfaces of vertical flanges 112 formed on pawl bracket 90. Dual torsion spring 104 is designed such that arm 108 exerts a forwardly directed biasing force on pawl member 86 for maintaining locked engagement of pawl locking tip 88 with sector teeth 84 when pawl member 86 is in the "locked" position. As will be appreciated, the particular number of sets of loops 110 formed on legs 106 is selected to provide the desired biasing force on pawl member 86. A spring steel cap 114 is installed on locking tip 88 to reduce wear of the pawl surface upon locking tip 88 "ratcheting" over sector teeth 84 in response to rearward "tilting" movement of chair frame 12. A speednut washer 116 is used for retaining pawl member 86 and hinge pin 92 between vertical flanges 112 of pawl bracket 90. Pawl bracket 90 also includes an aperture and an extruded hole for attaching the bracket to the chair base. The extruded hole prevents the bracket from rotating and enables it to be attached to the chair base with a single fastener.

In accordance with the principles of the present invention, pawl and ratchet latching mechanism 22 also includes a "non-loaded" release member 118 which operably interconnects pawl member 86 and an actuation assembly 120 that is supported from drive rod 32. For purposes of clarity, "non-loaded" is used to define the condition wherein release member 118 does not function to exert loading on pawl member 86 for maintaining locked engagement of pawl member 86 with sector teeth 84. Non-loaded release member 118 is shown in FIGS. 1 through 5 as a connecting wire 122 having a first end 124 releasably secured in a stuck-out loop 126 formed in pawl member 86. A second end 128 of connecting wire 122 is releasably retained in an aperture 130 formed in a leg portion 132 of a swivel lever 134. The opposite end of swivel lever 134 is journally supported on square drive rod 32 with a nylon bushing 136 used to isolate swivel lever 134 from drive rod 32. More specifically, nylon bushing 136 includes a hollow stub projection 137 having a square aperture sized to receive drive rod 32 therein. As such, nylon bushing 136 rotates with drive rod 32. In addition, the exterior cylindrical surface of stub projection 137 is journalled within circular aperture 138 of swivel lever 134. A trip link 140 having a square aperture 142 sized for receipt of square drive rod 32 is fixed thereby for rotation with drive rod 32. Trip link 140 is formed to include a transversely extending flange 144 arranged to extend over a front edge of leg portion 132 of swivel lever 134. As best seen in FIG. 1, when leg rest assembly 18 is in its "stowed" position, flange 144 acts on the front edge of swivel lever leg portion 132 for retaining swivel lever 134 and, in turn, pawl member 86 in its rearwardly "released" position in opposition to the biasing of dual torsion spring 104.

Operation of pawl and ratchet latching mechanism 22 will now be described. When it is desired to retract leg rest assembly 18 from its fully extended position, actuation handle 48 is rotated in a first direction for causing corresponding rotation of trip link 140 which, in turn, causes flange 144 to engage swivel lever 132 for rotating swivel lever 134. Such rotation of swivel lever 134 causes a front edge of aperture 130 to contact second end 128 of non-loaded release member 118. In this manner, release member 118 is "pulled" rearwardly in response to continued rotation of swivel lever 134 for pivoting pawl member 86 in a direction toward is "released" position. As such, chisel-shaped end 88 is withdrawn from teeth 84 of ratchet sector 82. In its "released" position, the rearward pivoted displacement of pawl member 86 is limited by tang 100 engaging base surface 102 of pawl bracket 90. This feature limits the stress exerted in opposing dual torsion spring 104 which permits utilization of lighter weight spring members. Thereafter, chair frame 12 is capable of unrestricted rocking action on base assembly 14 in a well known manner.

As previously noted, latching mechanism 22 is operably moved to its "locked" position upon movement of leg rest assembly 18 to its elevated "extended" position. In general, FIG. 3 illustrates chair 10 in a substantially "upright" position with leg rest assembly 18 in its fully extended position following selective rotation of handle 48 and, in turn, drive rod 32 in a second direction (i.e., counterclockwise in the drawings) causes concurrent rotation of trip link 140 such that the biasing force exerted on pawl member 86 by dual torsion spring 104 drives pawl member 86 toward ratchet sector 82. As such, non-loaded release member 118 is "pulled" along with the forward movement of pawl member 86. Once locking tip 88 engages teeth 84 of ratchet sector 82, release member 118 remains un-loaded due to swivel lever 134 being journally supported on drive rod 32. As such, dual torsion spring 104 is solely responsible for exerting a controlled engagement force on pawl member 86.

Following extension of leg rest assembly 18, rearward "tilting" of chair frame 12 causes chisel-shaped locking tip 88 of pawl member 86 to sequentially "ratchet" over sector teeth 84 until the desired degree of tilt has been reached. In this manner, the rocking components of chair 10 are effectively "locked-out" for preventing chair frame 12 from returning to its forward "non-tilted" position. When it is desired to return chair frame 12 to its "upright" position from a rearwardly "tilted" position, handle 48 is rotated in the first direction to withdraw chisel-shaped locking tip 88 of pawl member 86 from sector teeth 84 in the manner previously disclosed. As such, chair frame 12 is free to resume normal "rocking" action with leg rest assembly 18 in its "stowed" position.

In accordance with another feature of the present invention, aperture 130 in swivel lever 134 is preferably formed as an elongated lost-motion guide slot, as is clearly shown in FIG. 5. The advantage of using elongated lost-motion guide slots is two-fold. First, they permit sliding movement of first end 124 of release member 118 therein which ensures that release member 188 is maintained in its "non-loaded" state when pawl member 86 is in its "locked38 position. Secondly, the length of the guide slots permits universality of the various components associated with pawl and ratchet latching mechanism 22. To this end, latching mechanism 22 can be used with numerous differently sized combinations of chair frames and base assemblies.

As an additional benefit of latching mechanism 22, non-loaded release member 118 is designed to facilitate easy assembly or disassemble without requiring the use of tools. This feature permits relatively simple field service without requiring excessive disassembly of the components or manipulation thereof. As best seen in FIG. 5, first and second ends 124 and 128, respectively, of connecting wire 122 each have a U-shaped bend 150 which terminate in a "hook-like" tip 152. Tip 152 is provided for snapping over a portion of connecting wire 122 such that ends 124 and 128 define releasable locking loops. In addition, U-shaped bends 150 are formed to include a relatively large radius for reducing the chance of failure from fatigue.

With particular reference now to FIG. 7, a second preferred embodiment of pawl and ratchet latching mechanism 22' is shown which is also operable for releasably retaining chair frame 12 in any one of a plurality of rearwardly "tilted" sequential positions upon leg rest assembly 18 being moved to its fully extended position. Pawl and ratchet latching mechanism 22' is controllably actuated in response to angular movement of drive rod 32 and is operably arranged between front rail 78 of chair frame 12 and forward cross rail 80 of base assembly 14. For the sake of clarity, like numbers are used to identify like components previously disclosed herebefore.

With continued reference to FIG. 7, a spring-biased pawl assembly 97' is shown to include pawl member 86 secured by hinge pin 92 from pawl bracket 90 for pivotable movement between the "released" position (FIG. 1) and the "locked" position (FIG. 3). Again, a spring member is provided for normally biasing pawl member 86 in a direction toward ratchet sector 82 or, more simply, toward the "locked" position. The spring member is a leaf spring 160 having a first end 162 secured to base surface 102 of pawl bracket 90 in a manner causing an upwardly extending portion 164 to engage pawl member 86 for exerting a spring biasing force thereon. Leaf spring 160 is designed to exert a biasing force on pawl member 86 that is sufficient for maintaining locked engagement of pawl locking tip 88 with sector teeth 84 when pawl member 86 is in the "locked" position, while concurrently minimizing the "ratcheting" noise generated between locking tip 88 and ratchet teeth 84.

Pawl and ratchet latching mechanism 22' also includes a "non-loaded" release member 166 which is provided for interconnecting pawl member 86 and an actuation member 168. Non-loaded release member 166 is a relatively rigid connecting link 169 having a first end 170 releasably secured in stuck-out loop 126 formed in pawl member 86. The opposite end 172 of connecting link 169 is releasably retained in an elongated contoured guide slot 174 formed in actuation member 168. Actuation member 168 has a square aperture 178 sized for receipt of drive rod 32 therein such that actuation member 168 is fixed for rotation with drive rod 32. In general, contoured guide slot 174 acts as a "track" within which second end 172 of connecting link 169 is slidably movable in response to selective rotation of drive rod 32 for causing movement of pawl member 86 between its "released" and "locked" positions. In the "released" position shown in FIG. 7 (i.e., with leg rest assembly 18 in its "retracted" position), actuation member 168 is shown to be oriented with respect to drive rod 32 such that second end 172 of connecting link 169 is slidably guided within a first track 180 of contoured guide slot 174. A leading stop edge 182 of first track 180 engages second end 172 for "pulling" pawl member 86 rearwardly in a direction away from ratchet teeth 84 of ratchet sector 82.

As will be appreciated, as drive rod 32 and actuation member 168 are slightly rotated for initiating extension of leg rest assembly 18, the profile of first track 180 permits forward sliding movement connecting link 169 in response to forward pivotable movement of pawl member 86 due to the biasing force exerted thereon by leaf spring 160. Following engagement of locking tip 88 and sector teeth 84, a second track 184 co-operates with connecting link 169 to inhibit exertion of any compressive loading on connecting link 164 upon continued rotation of drive rod 32. Guide slot 174 is shown formed in a generally C-shaped contour having first track 180 controlling forward motion of connecting link 169 in response to movement of pawl member 86, and second track 184 for maintaining connecting link 169 in an "non-loaded" state upon continued rotation of drive rod 32 and actuation member 168 until leg rest assembly 18 is fully extended. However, it is to be understood that the particular contour of guide slot 174 is merely exemplary and could easily be modified to facilitate application of latching mechanism 22' in virtually any suitable rocking chair having an extensible leg rest assembly. For example, guide slot 174 could be enlarged to define a generally triangular aperture.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A rocking chair comprising:

a base;

a chair frame supported for rocking movement on said base;

a drive mechanism suspended from said chair frame;

a leg rest assembly suspended from said drive mechanism for movement between a retracted position and an extended position in response to actuation of said drive mechanism;

actuation means for permitting a seat occupant to selectively actuate said drive mechanism;

a ratchet sector secured to said chair frame and having ratchet teeth formed thereon;

a pawl member secured to said base for pivotable movement between a first position lockingly engaging said ratchet teeth wherein said chair frame is releasably locked in a rearwardly tilted position, and a second position released from said ratchet teeth for permitting unrestricted rocking movement of said chair frame;

spring means for normally biasing said pawl member toward said first position, said spring means adapted to exert an engagement force on said pawl member for maintaining locked engagement with said ratchet teeth when said pawl member is in said first position;

a first member supported on said drive means and having aperture means formed therein; and a release member having a first end coupled to said pawl member and a second end retained within said aperture means of said first member, said release member adapted to pull said pawl member to said second position when said drive mechanism is actuated for moving said leg rest assembly to said retracted position, said spring means being operable to urge said pawl member to said first position when said drive mechanism is actuated for moving said leg rest assembly to said extended position such that said release member is slidably movable within said aperture means for inhibiting said release member from exerting a biasing force on said pawl member whereby said release member is maintained in an unloaded condition.

2. The rocking chair of claim 1 wherein said drive mechanism includes an elongated drive rod supported for rotation within said chair frame, and said actuation means is coupled to said drive rod for permitting said seat occupant to rotate said drive rod in a first direction for moving said leg rest assembly toward said retracted position, and a second direction for moving said leg rest assembly toward said extended position.

3. The rocking chair of claim 2 wherein said first member is a swivel lever that is journally supported on said drive rod, said rocking chair further comprising a second member fixed for rotation on said drive rod and adapted to engage said swivel lever in response to rotation of said drive rod in said first direction for causing limited rotation of said swivel lever such that said release member pulls said pawl member toward said second position in opposition to the biasing of said spring means.

4. The rocking chair of claim 3 wherein said second member is adapted to disengage said swivel lever in response to rotation of said drive rod in said second direction such that said spring means urges said pawl member toward said first position and pulls said release member until said pawl member lockingly engages said ratchet teeth, whereby continued rotation of said drive rod in said second direction for fully extending said leg rest assembly causes said swivel lever to maintain said release member in said unloaded condition.

5. The rocking chair of claim 4 wherein said aperture means formed in said swivel lever is an elongated guide slot sized to permit sliding movement of said release member therein when said pawl member is in said second position.

6. The rocking chair of claim 4 wherein said second member includes flange means arranged for acting on and rotating said swivel lever when said leg rest assembly is moved toward said retracted position, whereby an end portion of said aperture means contacts said second end of said release member for pulling said release member such that said pawl member is concurrently pivoted to said second position.

7. The rocking chair of claim 4 wherein said spring means is a dual torsion spring acting on said pawl member.

8. The rocking chair of claim 7 wherein said dual torsion spring has a pair of laterally spaced legs, the free ends of which are arranged to engage a surface of a pawl bracket to which a first end of said pawl member is secured for pivotable movement about a hinge pin, said dual torsion spring having a transverse arm interconnecting said laterally spaced legs which engages a surface of said pawl member for exerting said biasing force thereon.

9. The rocking chair of claim 8 wherein said arm of said dual torsion spring engages said pawl member in close proximity to said hinge pin such that said biasing force is applied to said pawl member at a position displaced from a locking tip portion of said pawl member provided for releasably engaging said ratchet teeth.

10. The rocking chair of claim 4 wherein said pawl member includes stop means for limiting pivotable movement thereof toward said second position.

11. The rocking chair of claim 4 wherein said release member is a connecting wire having means for releasable coupling its first and second ends to said pawl member and swivel lever, respectively.

12. The rocking chair of claim 2 wherein said first member is fixed for rotation with said drive rod and said aperture means is an elongated guide slot having first track means cooperating with said release member for permitting pivotable movement of said pawl member toward said first position in response to initial rotation of said drive rod in said second direction, and second track means for maintaining said release member in said unloaded state upon continued rotation of said drive rod in said second direction following locked engagement of said pawl member and said ratchet teeth.

13. The rocking chair of claim 12 wherein said first and second track means are arranged to define a generally C-shaped guide slot in said first member.

14. The rocking chair of claim 12 wherein said aperture means is a generally triangular cut-out such that said first track means is a first edge surface thereof and said second track means is a second edge surface thereof.

15. A latching mechanism for releasably locking a chair frame of a rocking chair in a rearwardly tilted position relative to a stationary base assembly following actuation of a drive mechanism for moving a leg rest assembly from a retracted position to an extended position, said latching mechanism comprising;

a ratchet sector fixed to said chair frame and having ratchet teeth formed thereon;

a pawl member fixed to said base assembly for pivotable movement between a first position engaged with said ratchet teeth for locking said chair frame in said rearwardly tilted position and a second position disengaged from said ratchet teeth for permitting unrestricted rocking movement of said chair frame on said base assembly;

a first member supported from said drive mechanism;

a release member interconnected between said pawl member and said first member for pulling said pawl member from said first position to said second position in response to actuation of said drive mechanism causing said leg rest assembly to move from said extended position toward said retracted position;

spring means acting on said pawl member for urging said pawl member to said first position on response to actuation of said drive mechanism causing said leg rest assembly to move from said retracted position toward said exerted position; and means for maintaining said release member in an unloaded condition upon continued movement of said leg rest assembly to a fully extended position such that said release member does not exert a biasing load on said pawl member, said means for maintaining including aperture means formed in said first member, said release member having a first end coupled to said pawl member and a second end retained within said aperture means such that said release members is slidably confined within said aperture means.

16. The latching mechanism of claim 15 wherein said drive mechanism includes an elongated drive rod suspended for rotation from said chair frame, and manually-operated means coupled to said drive rod and permitting a seat occupant to rotate said drive rod in a first direction for moving said leg rest assembly toward said retracted position, and a second direction for moving said leg rest assembly toward said extended position.

17. The latching mechanism of claim 16 wherein said first member is a swivel lever that is journally supported on said drive rod, said latching mechanism further comprising a second member fixed for rotation on said drive rod and adapted to engage said swivel lever in response to rotation of said drive rod in said first direction for causing limited rotation of said swivel lever such that said release member pulls said pawl member toward said second position in response to such rotation of said swivel lever.

18. The latching mechanism of claim 17 wherein said second member is adapted to disengage said swivel lever in response to rotation of said drive rod in said second direction such that said spring means urges said pawl member toward said first position and pulls said release member until said pawl member lockingly engages said ratchet teeth, whereby continued rotation of said drive rod in said second direction for fully extending said leg rest assembly causes said swivel lever to maintain said release member in said unloaded condition.

19. The latching mechanism of claim 18 wherein said aperture means formed in said swivel lever is an elongated guide slot sized to permit sliding movement of said release member therein when said pawl member is in said second position.

20. The latching mechanism of claim 18 wherein said second member includes flange means aligned to act on and rotate said swivel lever when said leg rest assembly is moved toward said retracted position, whereby an end portion of said aperture means contacts said second end of said release member for pulling said release member such that said pawl member is concurrently pivoted to said second position.

21. The latching mechanism of claim 17 wherein said spring means is a dual torsion spring arranged to act directly on said pawl member.

22. The latching mechanism of claim 21 wherein said dual torsion spring has a pair of laterally spaced legs, the free ends of which are arranged to engage a surface of a pawl bracket to which a first end of said pawl member is secured for pivotable movement about a hinge pin, said dual torsion spring having a transverse arm interconnecting said laterally spaced legs which engages a surface of said pawl member for exerting said biasing force thereon.

23. The latching mechanism of claim 22 wherein said arm of said dual torsion spring engages said pawl member in close proximity to said hinge pin such that said biasing force is applied to said pawl member at a position displaced from a locking tip portion of said pawl member provided for releasably engaging said ratchet teeth.

24. The latching mechanism of claim 18 wherein said pawl member includes stop means for limiting pivotable movement thereof toward said second position.

25. The latching mechanism of claim 18 wherein said release member is a connecting wire having means for releasably coupling its first and second ends to said pawl member and swivel lever, respectively.

26. The latching mechanism of claim 16 wherein said first member is fixed for rotation with said drive rod and said aperture means is an elongated guide slot having first track means cooperating with said release member for permitting forward pivotable movement of said pawl member toward said first position in response to initial rotation of said drive rod in said second direction, and second track means for maintaining said release member in said unloaded state upon continued rotation of said drive rod in said second direction following engagement of said pawl member and said ratchet teeth.

27. The latching mechanism of claim 26 wherein said first and second track means are arranged to define a generally C-shaped guide slot in said actuation member.

28. The latching mechanism of claim 26 wherein said aperture means is a generally triangular cut-out such that said first track means is a first edge surface thereof and said second track means is a second edge surface thereof.

29. A latching mechanism for releasably locking a chair frame of a rocking chair in a rearwardly tilted position relative to a stationary base assembly following actuation of a drive mechanism for moving a leg rest assembly from a retracted position to an extended position, said latching mechanism comprising;

a ratchet sector fixed to said chair frame and having ratchet teeth formed thereon;

a pawl member fixed to said base assembly for pivotable movement between a first position engaged with said ratchet teeth for locking said chair frame in said rearwardly tilted position and a second position disengaged from said ratchet teeth for permitting unrestricted rocking movement of said chair frame on said base assembly;

a first member supported from said drive mechanism;

a release member interconnected between said pawl member and said first member for pulling said pawl member from said first position to said second position in response to actuation of said drive mechanism causing said leg rest assembly to move from said extended position toward said retracted position;

dual torsion spring means acting on said pawl member for urging said pawl member to said first position in response to actuation of said drive mechanism, said spring means comprising a pair of laterally spaced legs having free ends arranged to engage a surface of a pawl bracket to which a first end of said pawl member is secured for pivotable movement about a hinge pin, and a transverse arm interconnecting said laterally spaced legs which engages a surface of said pawl member for exerting said biasing force thereon; and means for maintaining said release member in an unloaded condition upon continued movement of said leg rest assembly to a fully extended position such that said release member does not exert a biasing load on said pawl member.

30. The latching mechanism of claim 29 wherein said arm of said dual torsion spring engages said pawl member in close proximity to said hinge pin such that said biasing force is applied to said pawl member at a position displaced from a locking tip portion of said pawl member provided for releasably engaging said ratchet teeth.

31. The latching mechanism of claim 29 wherein said means for maintaining said release member in said unloaded condition includes aperture means formed in said first member, said release member having a first end coupled to said pawl member and a second end retained within said aperture means such that said release member is slidably confined within said aperture means.

32. The latching mechanism of claim 31 wherein said drive mechanism includes an elongated drive rod suspended for rotation from said chair frame, and manually-operated means coupled to said drive rod and permitting a seat occupant to rotate said drive rod in a first direction for moving said leg rest assembly toward said retracted position, and a second direction for moving said leg rest assembly toward said extended position.

33. The latching mechanism of claim 32 wherein said first member is a swivel lever that is journally supported on said drive rod, said latching mechanism further comprising a second member fixed for rotation on said drive rod and adapted to engage said swivel lever in response to rotation of said drive rod in said first direction for causing limited rotation of said swivel lever such that said release member pulls said pawl member toward said second position in response to such rotation of said swivel lever.

34. The latching mechanism of claim 33 wherein said second member is adapted to disengage said swivel lever in response to rotation of said drive rod in said second direction such that said spring means urges said pawl member toward said first position and pulls said release member until said pawl member lockingly engages said ratchet teeth, whereby continued rotation of said drive rod in said second direction for fully extending said leg rest assembly causes said swivel lever to maintain said release member in said unloaded condition.

35. The latching mechanism of claim 34 wherein said second member includes flange means aligned to act on and rotate said swivel lever when said leg rest assembly is moved toward said retracted position, whereby an end portion of said aperture means contacts said second end of said release member for pulling said release member such that said pawl member is concurrently pivoted to said second position.

36. The latching mechanism of claim 31 wherein said aperture means formed in said first member is an elongated guide slot sized to permit sliding movement of said release member therein when said pawl member is in said second position.

* * * * *

UNITED STATES PATENT AND TRADEMARK OFFICE

CERTIFICATE OF CORRECTION

PATENT NO. : 5,328,235

DATED : July 12, 1994

INVENTOR(S) : Jonathan R. Saul, et al.

It is certified that error appears in the above-indentified patent and that said Letters Patent is hereby corrected as shown below:

Column 1, line 9,
"on" should be -- in--.

Column 2, line 8,
after "the" (first occurrence in patent, third occurrence in application) insert --teeth of--.

Column 6, line 15,
"protected" should be --protracted--.

Column 6, line 25,
"block" should be --blocks--.

UNITED STATES PATENT AND TRADEMARK OFFICE

CERTIFICATE OF CORRECTION

PATENT NO. : 5,328,235

DATED : July 12, 1994

INVENTOR(S) : Jonathan R. Saul, et al.

It is certified that error appears in the above-indentified patent and that said Letters Patent is hereby corrected as shown below:

Column 9, line 14,
"locked38" should be --locked--.

Column 13, line 61, claim 21,
"17" should be --18--.

Signed and Sealed this

Eighteenth Day of October, 1994

Bruce Lehman

*Attest:*

BRUCE LEHMAN

*Attesting Officer*

*Commissioner of Patents and Trademarks*